US008033685B2

(12) United States Patent
McGehee et al.

(10) Patent No.: US 8,033,685 B2
(45) Date of Patent: Oct. 11, 2011

(54) LED LUMINAIRE

(76) Inventors: Michael Eugene McGehee, Jarrettsville, MD (US); John Thomas Adinolfi, Milltown, NJ (US)

( * ) Notice: Subject to any disclaimer, the term of this patent is extended or adjusted under 35 U.S.C. 154(b) by 190 days.

(21) Appl. No.: 12/413,472

(22) Filed: Mar. 27, 2009

(65) Prior Publication Data

US 2009/0244896 A1 Oct. 1, 2009

Related U.S. Application Data

(60) Provisional application No. 61/072,073, filed on Mar. 27, 2008.

(51) Int. Cl.
*F21V 21/00* (2006.01)

(52) U.S. Cl. ..... 362/249.02; 362/249.01; 362/249.03; 362/282; 362/372; 362/285

(58) Field of Classification Search ..... 362/249.01, 362/249.02, 249.03, 282, 452, 372, 285, 362/418–425, 283
See application file for complete search history.

(56) References Cited

U.S. PATENT DOCUMENTS

| | | | | |
|---|---|---|---|---|
| 7,407,304 | B2 * | 8/2008 | Tasson et al. | 362/249.07 |
| 7,581,856 | B2 * | 9/2009 | Kang et al. | 362/373 |
| 7,744,251 | B2 * | 6/2010 | Liu et al. | 362/294 |
| 7,753,560 | B2 * | 7/2010 | Xu et al. | 362/294 |
| 7,784,971 | B2 * | 8/2010 | Dorogi | 362/294 |
| 2002/0041499 | A1 * | 4/2002 | Pederson | 362/545 |
| 2007/0041220 | A1 * | 2/2007 | Lynch | 362/646 |
| 2010/0053964 | A1 * | 3/2010 | Yang et al. | 362/249.02 |

* cited by examiner

*Primary Examiner* — Evan Dzierzynski
(74) *Attorney, Agent, or Firm* — NSIP Law

(57) ABSTRACT

A luminaire includes a base, a lighting module disposed on the base, the lighting module including a mounting plate, and a plurality of light emitting diodes provided on the mounting plate, and a cover surrounding the lighting module and secured in the base, the cover optimally directing light emitted by the plurality of light emitting diodes.

19 Claims, 12 Drawing Sheets

*Method 1100*

LED LUMINAIRE

CROSS-REFERENCE TO RELATED APPLICATIONS

This application claims the benefit of U.S. Provisional Application No. 61/072,073, filed Mar. 27, 2008.

BACKGROUND OF THE INVENTION

1. Field of the Invention

The following description relates to the use of light emitting diodes (LEDs) in lighting applications, and, more specifically, to the use of LEDs to illuminate outdoor and public environments with light fixtures having a decorative and pleasant appearance.

2. Description of the Related Art

In certain outdoor and public environments, especially those environments in which lack of lighting is an issue, it is necessary to provide illumination for public safety and liability purposes. While the need for this illumination is geared primarily toward public safety and proactive preventative measures, it is generally desired that the provided illumination be implemented in an attractive and pleasing manner that will enhance the decorative ambiance of the particular environment.

Luminaires are conventionally implemented in these types of environments. Luminaires are light fixtures that can be designed to provide an optimal amount of illumination in an attractive manner that is pleasing to the eye. Luminaires can be designed in many different shapes and sizes to provide attractive illumination specific to the needs of the particular environment.

The conventional and long-standing light source that is used within a luminaire to output light is a high pressure sodium (HPS) device. The HPS device is largely similar in effect to a conventional incandescent light bulb used residentially in home lighting applications. Like such a bulb, the HPS device emits light in a 360 degree pattern providing uniformity of illumination throughout the luminaire.

However, there are a number of drawbacks to using HPS devices in luminaires. The HPS device is a high energy device that requires 120 V AC to operate. The HPS device converts the 120 V AC to a higher voltage at the luminaire. Then, the higher voltage at the luminaire increases until it spikes, creating a "strike arc". This creates unsafe high currents which could prove deadly to human and animal life in certain situations. In addition, the HPS device generally requires more energy as it draws nearer to the end of its life span.

Moreover, the HPS device creates light by burning gas. In turn, the burning of the gas creates a tremendous amount of heat. Again, the amount of heat created by the HPS device could be hazardous to both humans and animals. The HPS device also contains mercury, which is known to be hazardous to humans and animals as well as the environment.

Further, the HPS device has a high maintenance requirement. Specifically, the HPS device utilizes a ballast. This ballast has a typical life in a range of 3-5 years. Also, the HPS device utilizes a bulb having a typical life span in a range of 10,000 to 24,000 hours. The life span of the bulb may be further negatively affected by various shock and vibration.

In addition, the HPS device has very poor color rendering and produces an extremely yellow light, which, in turn, affects the color of objects being illuminated by the HPS device. For example, a car having a brown color in normal lighting may have a black color when illuminated by the HPS device. Also, a sweatshirt having a red color in normal lighting may have a dark brown color when illuminated by the HPS device. Moreover, the human eye has a decreased sensitivity to yellow light, which further exacerbates the color rendering problems of the HPS device.

The HPS device is also extremely slow to illuminate, typically requiring five minutes to arrive at full illumination levels. Moreover, when the HPS device loses power for even a fraction of a second, the HPS device is required to go through a cool-down/restart period. This cool-down/restart period requires up to seven minutes for the HPS device to resume full illumination levels after any short loss of power.

Needless to say, an alternative to using the HPS device with luminaires has been long-sought after. Metal halide devices have replaced the HPS devices in some situations. However, while producing better color rendering than HPS devices, metal halide devices have shorter lives than HPS devices. Metal halide devices also are not nearly as efficient as HPS devices. Thus, metal halide devices can only be used in certain applications.

In summary, an alternative to the use of HPS devices in luminaires is still being sought. A light source is desired having a low energy requirement, a maintained voltage and current, low heat generation, low maintenance, shock and vibration resistance, a long life span, good color rendering, little delay in producing illumination, and no harmful elements.

SUMMARY OF THE INVENTION

In view of the foregoing, a general aspect of examples described herein is to provide a luminaire using light emitting diodes (LEDs) for a light source in order to illuminate outdoor and public environments with light fixtures having a decorative and pleasant appearance.

In one general aspect, there is provided a luminaire, including a base, a lighting module disposed on the base, the lighting module including a mounting plate, and a plurality of light emitting diodes provided on the mounting plate, and a cover surrounding the lighting module and secured in the base, the cover optimally directing light emitted by the plurality of light emitting diodes.

The luminaire may further provide that the lighting module further includes a top plate, the top plate including a top plate tab extending downward, and a bottom portion, the bottom portion including a bottom portion tab extending upward. The mounting plate is fastened to and extends between the top plate tab and the bottom portion tab.

The luminaire may further provide that the mounting plate further includes a heat-conducting material. The plurality of light emitting diodes is formed on the heat-conducting material.

The luminaire may further provide that the plurality of light emitting diodes is connected to a power supply providing primarily direct current to the plurality of light emitting diodes. The lighting module is disposed on the power supply.

The luminaire may further provide that the lighting module includes a circular cross-section formed by a plurality of mounting plates.

The luminaire may further provide that the top plate and the bottom plate have pentagonal shapes, and the bottom portion of the lighting module is freely rotatable.

The luminaire may further provide that a cross-section of the top plate of the lighting module has a surface area that is greater than a surface area of any other cross-sectional portion of the lighting module.

The luminaire may further provide that the lighting module further includes a heat sink formed adjacent to the heat-conducting material of the mounting plate.

The luminaire may further provide that the lighting module further includes a top plate disposed above and fastened to the mounting plate such that the mounting plate is able to move inward towards a center portion of the lighting module and outward from the center portion of the lighting module to alter an angle between the mounting plate and a ground surface.

The luminaire may further provide that the top plate is fastened to the mounting plate at an upper portion of the mounting plate, the upper portion of the mounting plate folded such that an end of the upper portion is oriented towards the center portion of the lighting module.

The luminaire may further provide that the top plate includes a top plate tab that extends downward from the top plate and prevents the mounting plate from moving past an outer edge of the top plate.

The luminaire may further provide that the top plate includes a slot in which a fastener is placed, the mounting plate includes a hole in which the fastener is disposed, and the lighting module further includes a fitting that is disposed on the fastener and fixes the mounting plate to the top plate.

The luminaire may further provide that the top plate includes a slot in which a fastener is placed, the upper portion of the mounting plate includes a hole in which the fastener screw is disposed, and the lighting module further includes a fitting that is disposed on the screw and fixes the upper portion of the mounting plate to the top plate.

The luminaire may further provide that the lighting module further includes a bottom portion, the bottom portion including a bottom portion tab to which the mounting plate is fastened, the bottom portion tab extending upward.

In another aspect, there is provided a method of manufacturing a luminaire, including forming a base, forming a lighting module on the base, the forming the lighting module including forming a mounting plate, and forming a plurality of light emitting diodes on the mounting plate, and forming a cover that surrounds the lighting module and is secured in the base, the forming the cover to optimally direct light emitted by the plurality of light emitting diodes.

The method may further provide that the forming the lighting module further includes forming a top plate disposed above and fastened to the mounting plate such that the mounting plate is able to move inward towards a center portion of the lighting module and outward from the center portion of the lighting module to alter an angle between the mounting plate and a ground surface.

The method may further provide that the forming the top plate includes fastening the top plate to the mounting plate at an upper portion of the mounting plate, and folding the upper portion of the mounting plate such that an end of the upper portion is oriented towards the center portion of the lighting module.

In yet another aspect, there is provided a luminaire system, including a base forming unit for forming a base, a lighting module forming unit for forming a lighting module on the base, the lighting module forming unit including a mounting plate forming unit for forming a mounting plate, and a light emitting diode forming unit for forming a plurality of light emitting diodes on the mounting plate, and a cover forming unit for forming a cover that surrounds the lighting module, is secured in the base, and optimally directs light emitted by the plurality of light emitting diodes.

The system may further provide that the lighting module forming unit further includes a top plate forming unit for forming a top plate disposed above and fastened to the mounting plate such that the mounting plate is able to move inward towards a center portion of the lighting module and outward from the center portion of the lighting module to alter an angle between the mounting plate and a ground surface.

The system may further provide that the top plate forming unit includes a top plate fastening unit for fastening the top plate to the mounting plate at an upper portion of the mounting plate, and a upper portion folding unit for folding the upper portion of the mounting plate such that an end of the upper portion is oriented towards the center portion of the lighting module.

According to general aspects of examples described herein, a lighting module disposed on the base may include a mounting plate and a plurality of light emitting diodes provided on the mounting plate. The light emitting diodes (LEDs) may provide a light source having a low energy requirement, a maintained voltage and current, low heat generation, low maintenance, shock and vibration resistance, a long life span, good color rendering, little delay in producing illumination, and no harmful elements.

According to general aspects of examples described herein, a top plate may be disposed above and fastened to the mounting plate such that the mounting plate is able to move inward towards a center portion of the lighting module and outward from the center portion of the lighting module to alter an angle between the mounting plate and a ground surface. As a result, the adjustability of the mounting plate may allow for changes in light output and alignment with the cover to accommodate situational concerns, such as a layout of a specific area surrounding the luminaire, area obstructions that may impact illumination, and curvature in pathways designated to be illuminated. Other features and aspects may be apparent from the following detailed description, the drawings, and the claims.

BRIEF DESCRIPTION OF THE DRAWINGS

The foregoing and other aspects and features will be better understood from the following detailed description with reference to the drawings, in which.

DETAILED DESCRIPTION

The following detailed description is provided to assist the reader in gaining a comprehensive understanding of the methods, apparatuses, and/or systems described herein. For simplicity of description, examples described herein are applied to illumination of outdoor and public environments. One of ordinary skill in the art would clearly realize that examples of the methods, apparatuses, and/or systems described herein are not limited to these applications but are advantageously applicable to all applications requiring illumination. Examples of applicable environments include household lamp and fixture lighting, artistic and performance lighting, emergency lighting, traffic signal lighting, and so on.

Figure 1:
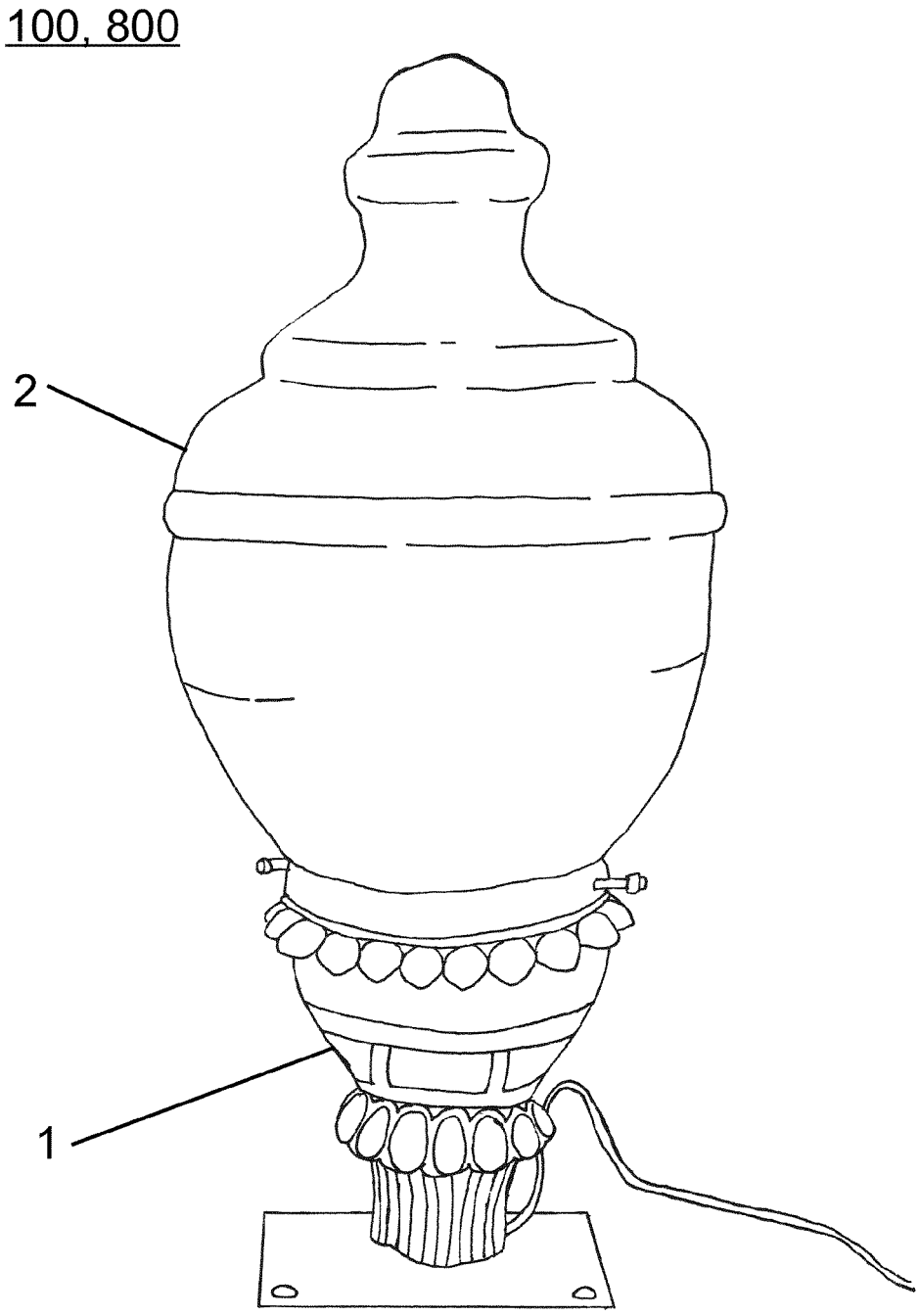
FIG. 1 illustrates an example of an outer portion of luminaires.

FIG. 1 illustrates an example of an outer portion of luminaires 100, 800. The luminaires 100, 800 include a base 1 and a cover 2. The cover 2 provided for the luminaires 100, 800 is universal in nature and can be used with any type of light source. A portion of the cover 2 fits into the base 1 such that the cover 2 can be locked into place by the base 1. Both the base 1 and cover 2 are not only designed to be functional but also to be decorative and pleasing to the eye. The cover 2 is specifically designed not only to hide the functional portions of the luminaires 100, 800, but also as a lens to emit light from the functional portions of the luminaires 100, 800.

While an example of the base 1 and the cover 2 is illustrated in FIG. 1 to represent the form of a decorative street light, one of ordinary skill in the art would clearly realize that the base 1 and the cover 2 may be designed in any manner that will allow the luminaires 100, 800 to function. Thus, one of ordinary skill in the art would clearly realize that examples of applicable environments for the luminaires 100, 800 include household lamp and fixture lighting, artistic and performance lighting, emergency lighting, traffic signal lighting, and so on, and that the base 1 and the cover 2 could be adapted to satisfy any aesthetic or functional design.

In addition, it is noted one of ordinary skill in the art would clearly realize that the cover 2 may be designed in any manner that allows light to be emitted through the cover 2 such that a subject of illumination is adequately illuminated by the luminaires 100, 800. Thus, one of ordinary skill in the art would clearly realize that examples of applicable environments for the luminaires 100, 800 are not limited to the form of a decorative street light.

FIGS. 2-6 illustrate various examples of an inner portion of the luminaire 100. The inner portion of the luminaire 100 represents the luminaire 100 without the cover 2 secured to the base 1. A conventional power supply 20 is disposed inside of a top portion 3 of the base 2. A bottom portion 216 of a lighting module 21 is attached to a top portion 202 of a housing 201 of the power supply 20. The lighting module 21 may include five mounting plates 211. Six light emitting diodes (LEDs) 210 may be disposed on each mounting plate 211.

While a lighting module 21 may include five mounting plates 211 with six LEDs 210 disposed on each of the five mounting plates 211, one of ordinary skill in the art would clearly realize that the number of mounting plates and the number of LEDs 210 included in the lighting module 21 can be adjusted to achieve optimal illumination of a desired subject.

The mounting plates 211 are attached to the bottom portion 216 of the lighting module 21. The LEDs 210 are directed outward from a center of the luminaire 100. The LEDs 210 may be powered through direct current supplied by the power supply 20, which converts 120 VAC to direct current, to provide a maintainable voltage and current to the LEDs 210. The power supply 20 is actively regulated in order to maintain light output emitted from the LEDs 210. The LEDs 210 are connected to the power supply 20 via known methods.

The mounting plates 211 are formed of a heat-conducting material. The mounting plates 211 may be formed from one of any good heat conducting metals such as, but not limited to, copper, steel, aluminum, and so on. The heat-conducting material allows heat formed in conjunction with the operation of the LEDs 210 to dissipate from the localized area of the LEDs 210 and to be distributed evenly across each respective mounting plate 211.

The even distribution of the heat across each respective mounting plate 211 also enhances the dissipation from the mounting plates 211 to the atmosphere surrounding the lighting module 21. Thus, while the amount of heat generated by the LEDs 210 is significantly less than the amount of heat generated by the aforementioned HPS device, the amount of heat that is generated by the LEDs 210 is managed in a way that does not place any unwanted stress on the mounting plates 211, the LEDs 210, or any other area of the lighting module 21. In addition to the heat-conducting material, a heat sink may also be used to aid in the convection of heat out of the heat-conducting material.

Unlike the aforementioned HPS device, the LEDs 210 emit light directionally. Therefore, the mounting plates 211 are used to orient the LEDs 210 in an efficient manner to, in conjunction with the cover 2, provide optimal illumination of the desired subject. In other words, the mounting plates 211 are specifically designed to accomplish the optimization of the illumination of the desired subject with the LEDs 210. The specific design of the mounting plates 211 is performed prior to installation and is dependent upon the specific design of the cover being used and the illumination requirements of the desired subject. As previously mentioned, any cover, including cover 2, acts not only to decoratively hide the lighting module 21 of the luminaires 100, 800, but also as a lens to emit the light emanating from the LEDs 210 of the lighting module 21 of the luminaires 100, 800.

Figure 5:
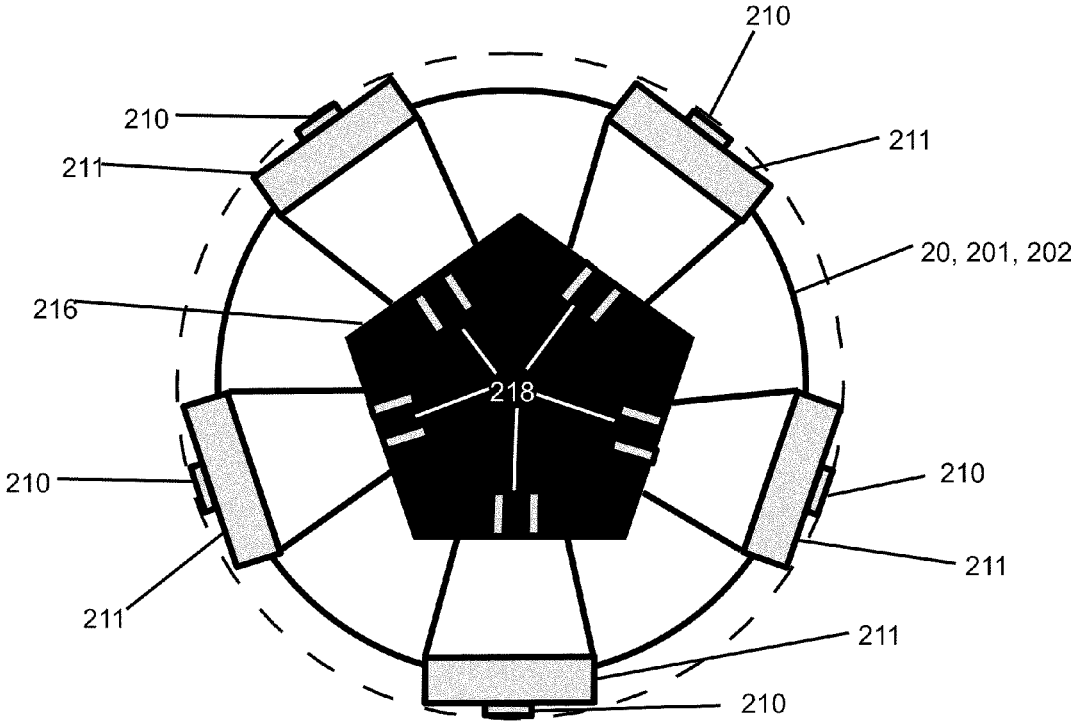
FIG. 5 illustrates a vertical cross-sectional view A-A' of one example of the inner portion of a luminaire where the mounting plates are formed in a circular cross-section.

FIG. 5 illustrates a vertical cross-sectional view A-A' of an example of the inner portion of the luminaire 100. Specifically, FIG. 5 illustrates an example where the mounting plates 211 may be required to be designed such that a circular cross-section orientation exists to effectively illuminate a desired subject with the LEDs 210. However, one of ordinary skill in the art would clearly realize that the mounting plates 211 may be oriented through specific design in any way necessary to effectively illuminate a desired subject with the LEDs 210. A specific geometrically-valid cross-sectional shape is not a requirement for effective illumination of a desired subject with the LEDs 210.

Figure 3:
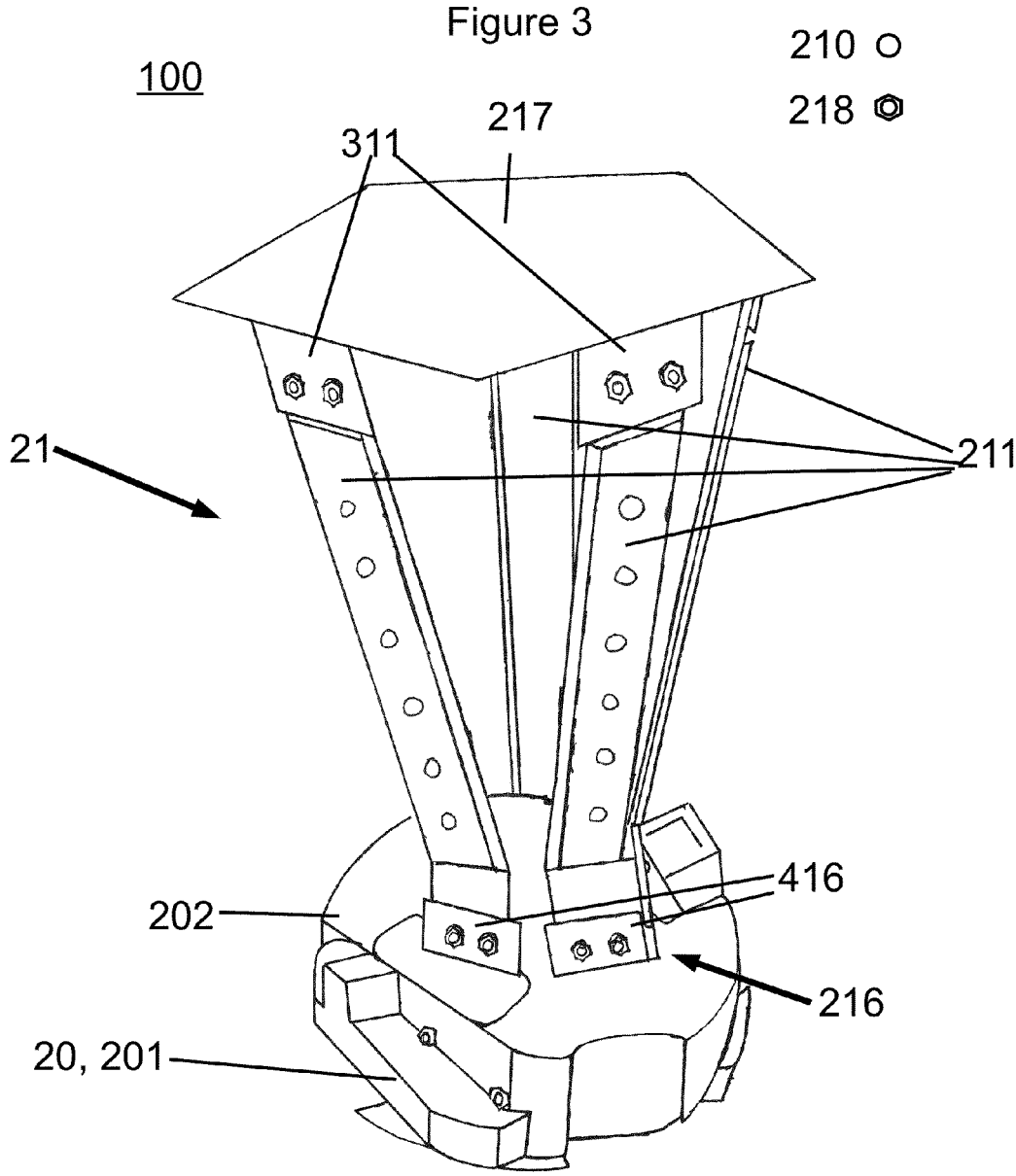
FIG. 3 illustrates a plan view of one example of an inner portion of a luminaire.
Figure 6:
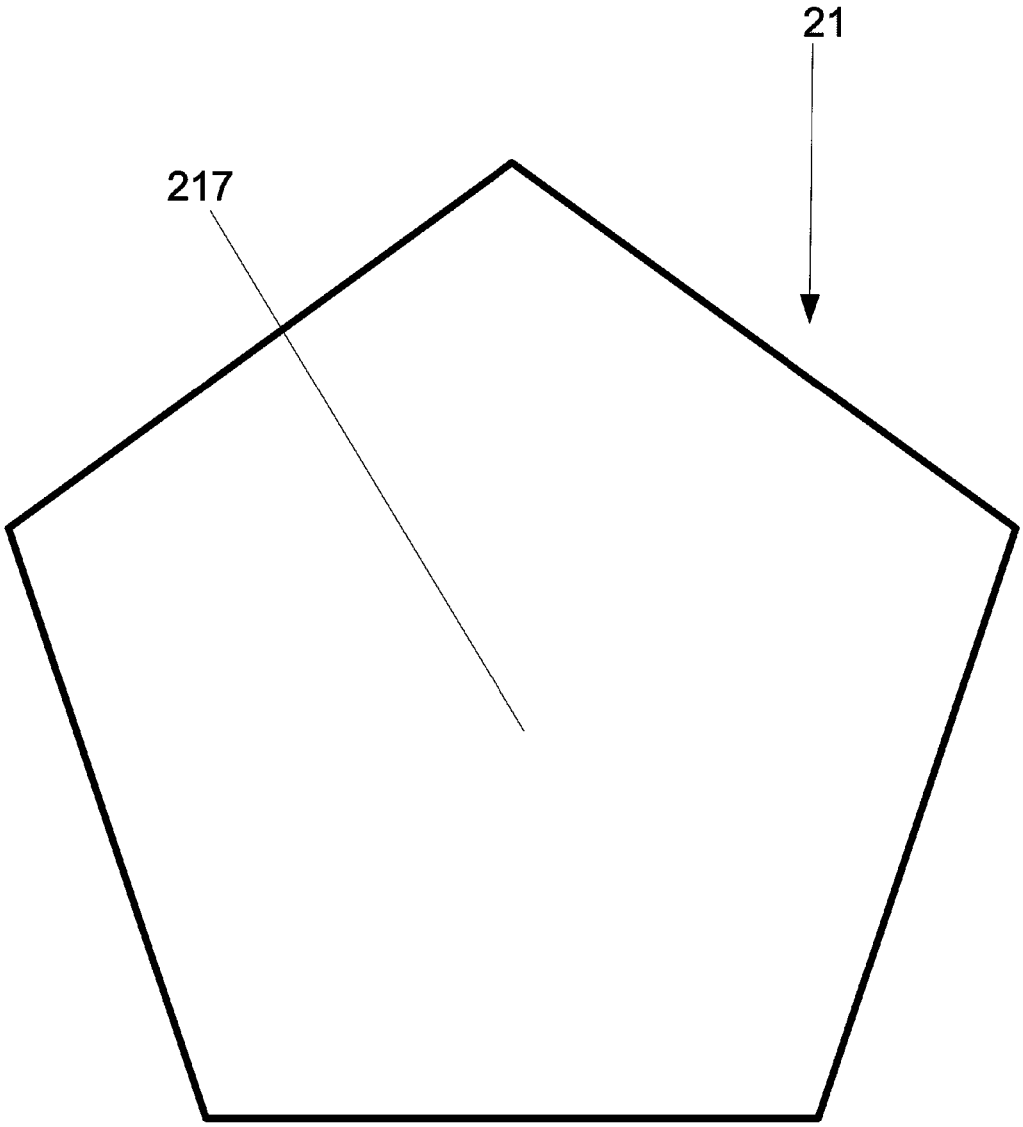
FIG. 6 illustrates a top view of one example of the inner portion of a luminaire.
Figure 7:
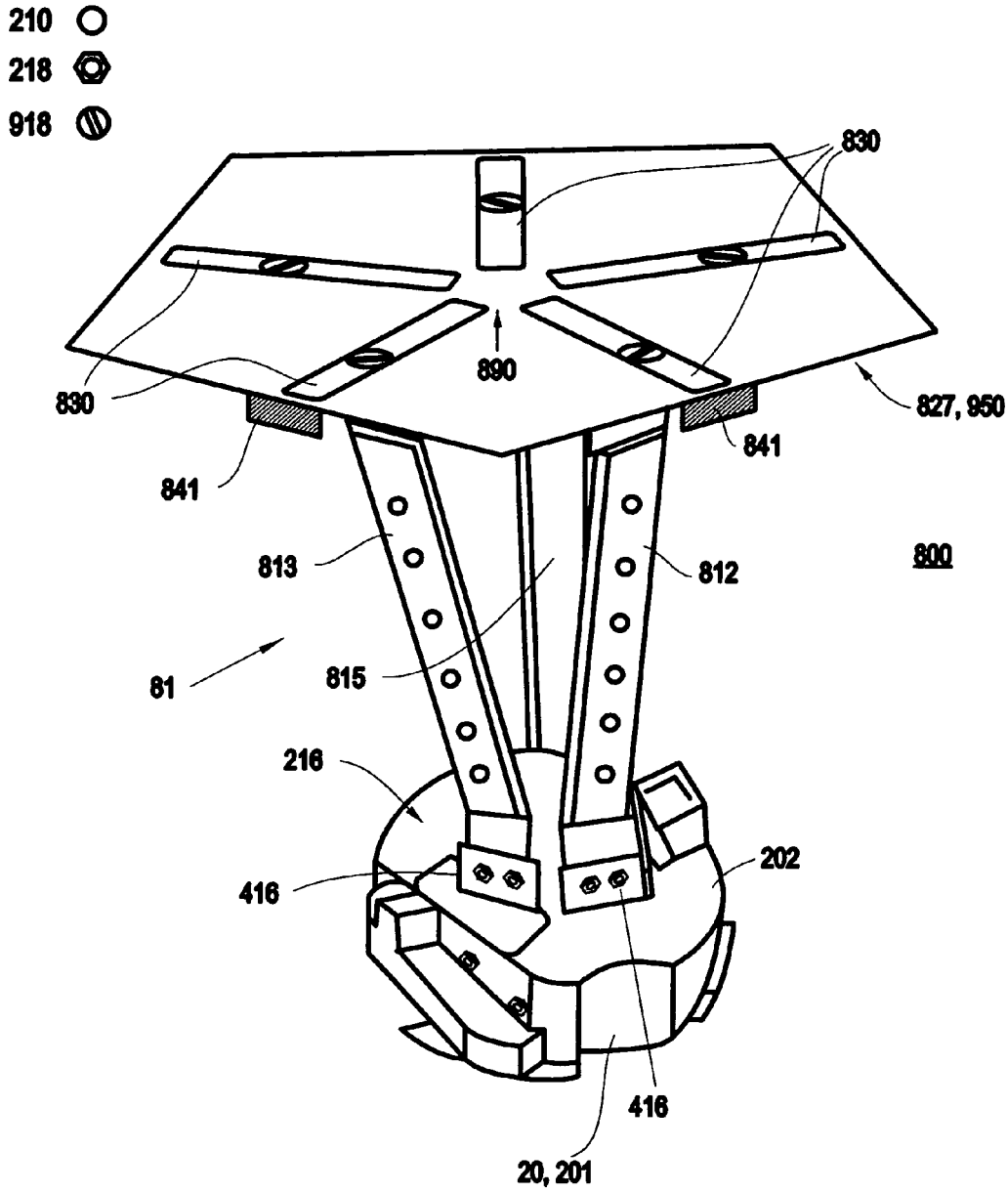
FIG. 7 illustrates a plan view of another example of an inner portion of a luminaire.
Figure 8:
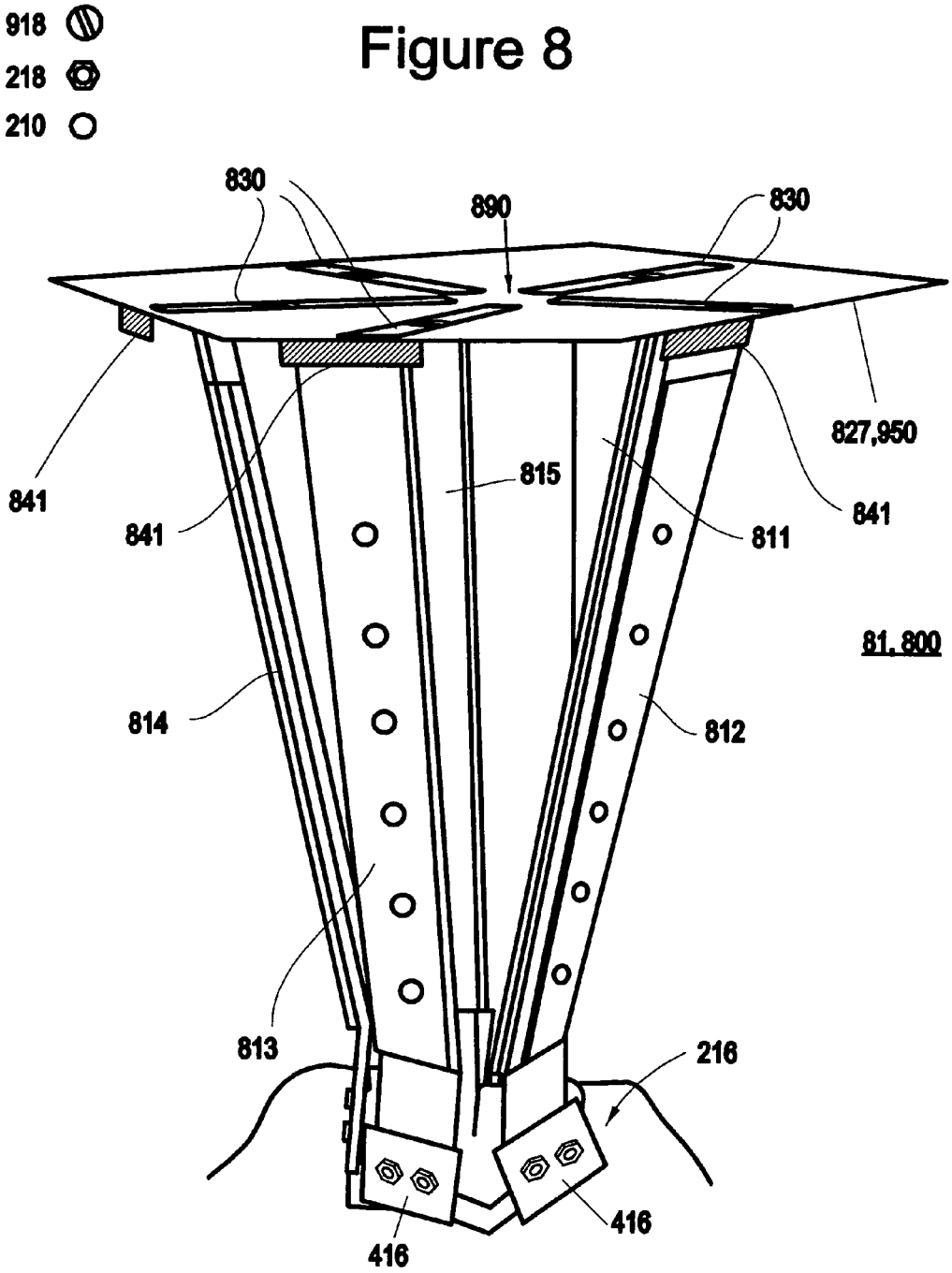
FIG. 8 illustrates a side view of another example of the inner portion of a luminaire.
Figure 9:
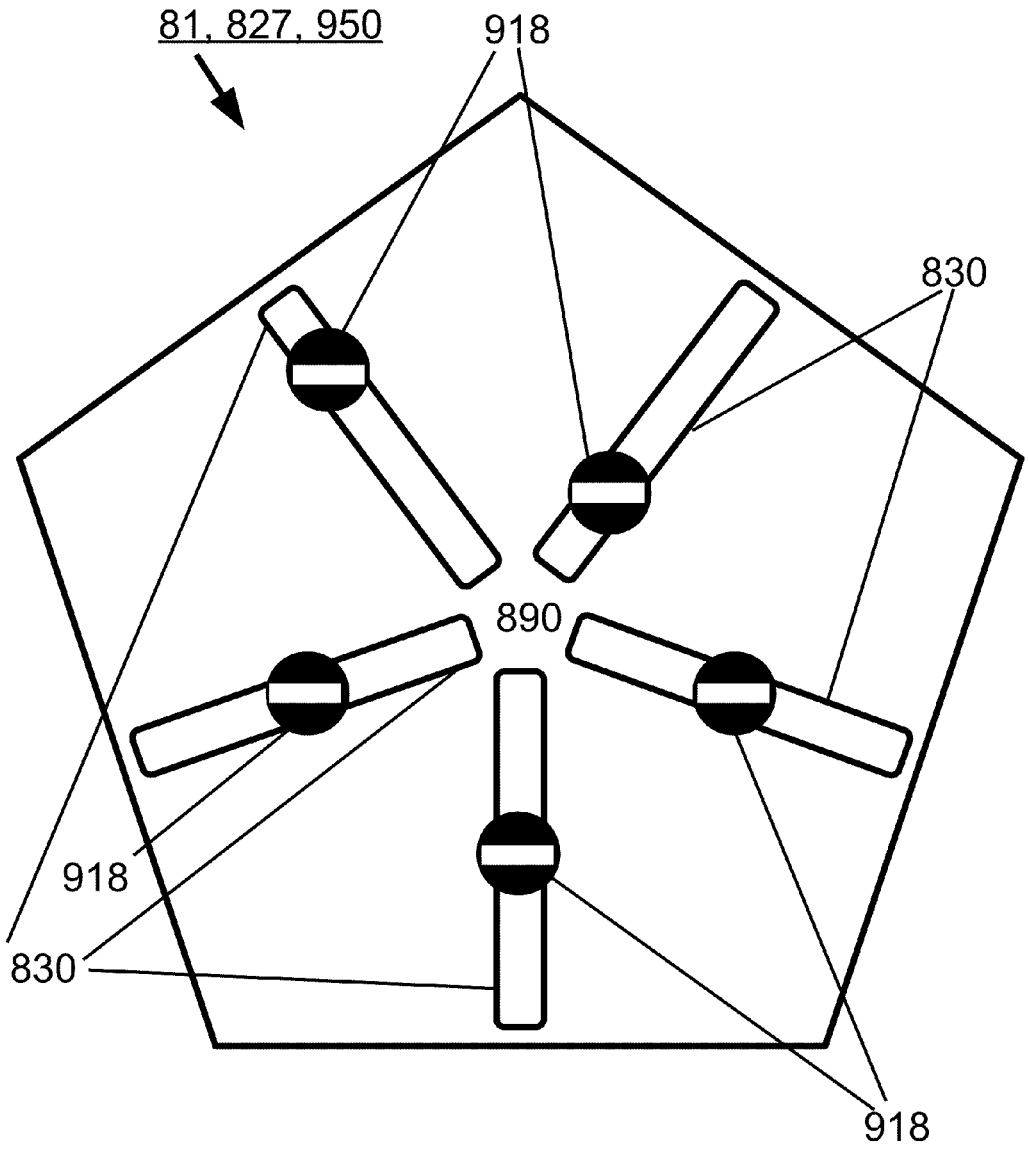
FIG. 9 illustrates a top view of another example of the inner portion of a luminaire.
Figure 10:
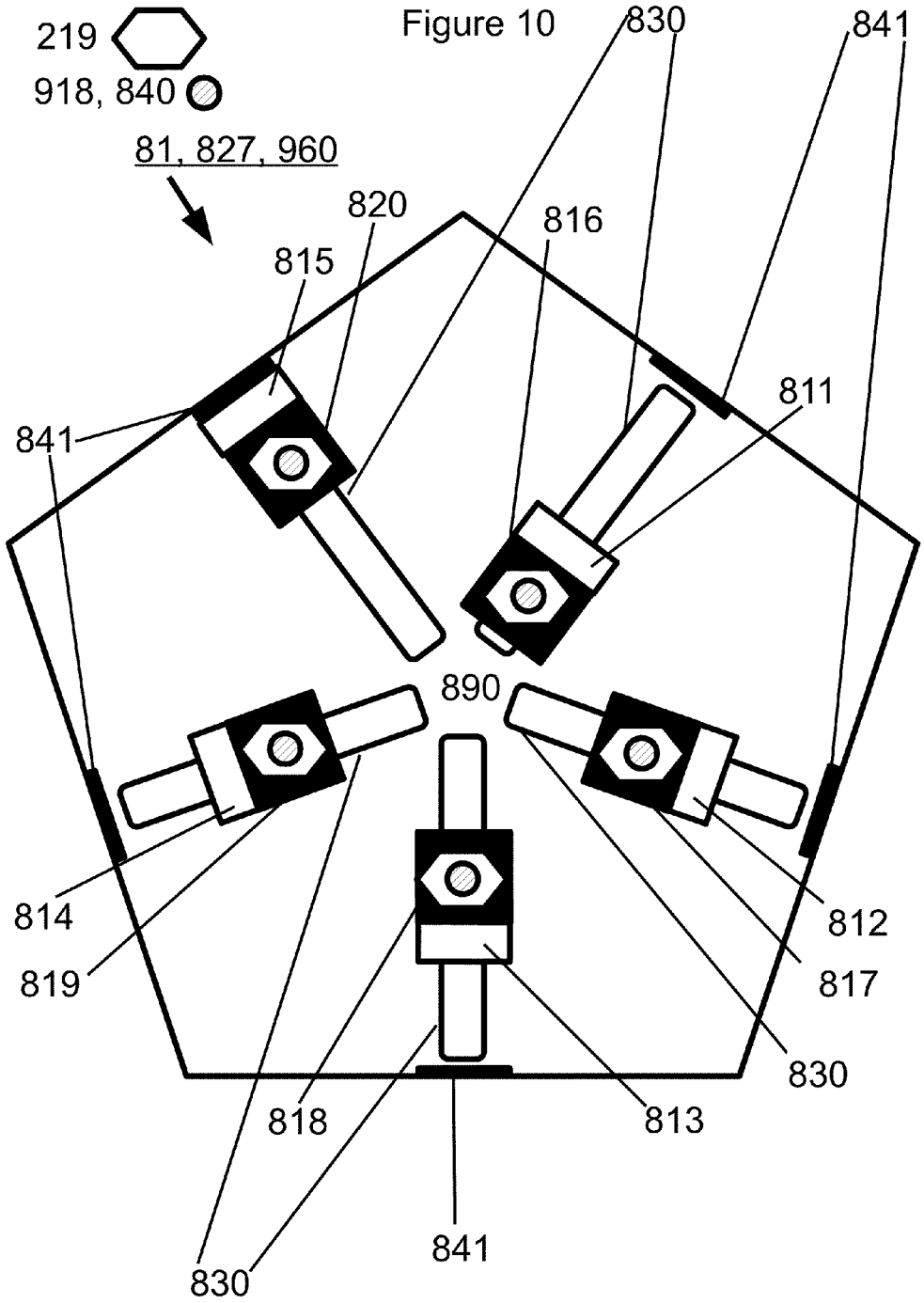
FIG. 10 illustrates a bottom view of another example of a top plate of a luminaire.

The mounting plates 211 are also affixed to a top plate 217 of the lighting module 21. FIG. 6 illustrates a top view of an example of the inner portion of the luminaire 100. The top plate 217 has the largest surface area of any cross-sectional portion of the lighting module 21. In FIGS. 3 and 6, the top plate 217 of the lighting module 21 may have the shape of a pentagon. However, one of ordinary skill in the art would clearly realize that it is not necessary for the shape of the top plate 217 to be of a pentagon. One of ordinary skill in the art would also clearly realize that it is not necessary for the top plate 217 to have a defined geometrical shape. The top plate 217 of the lighting module 21 may be designed to have a form that enables the optimal illumination of a desired subject.

Figure 4:
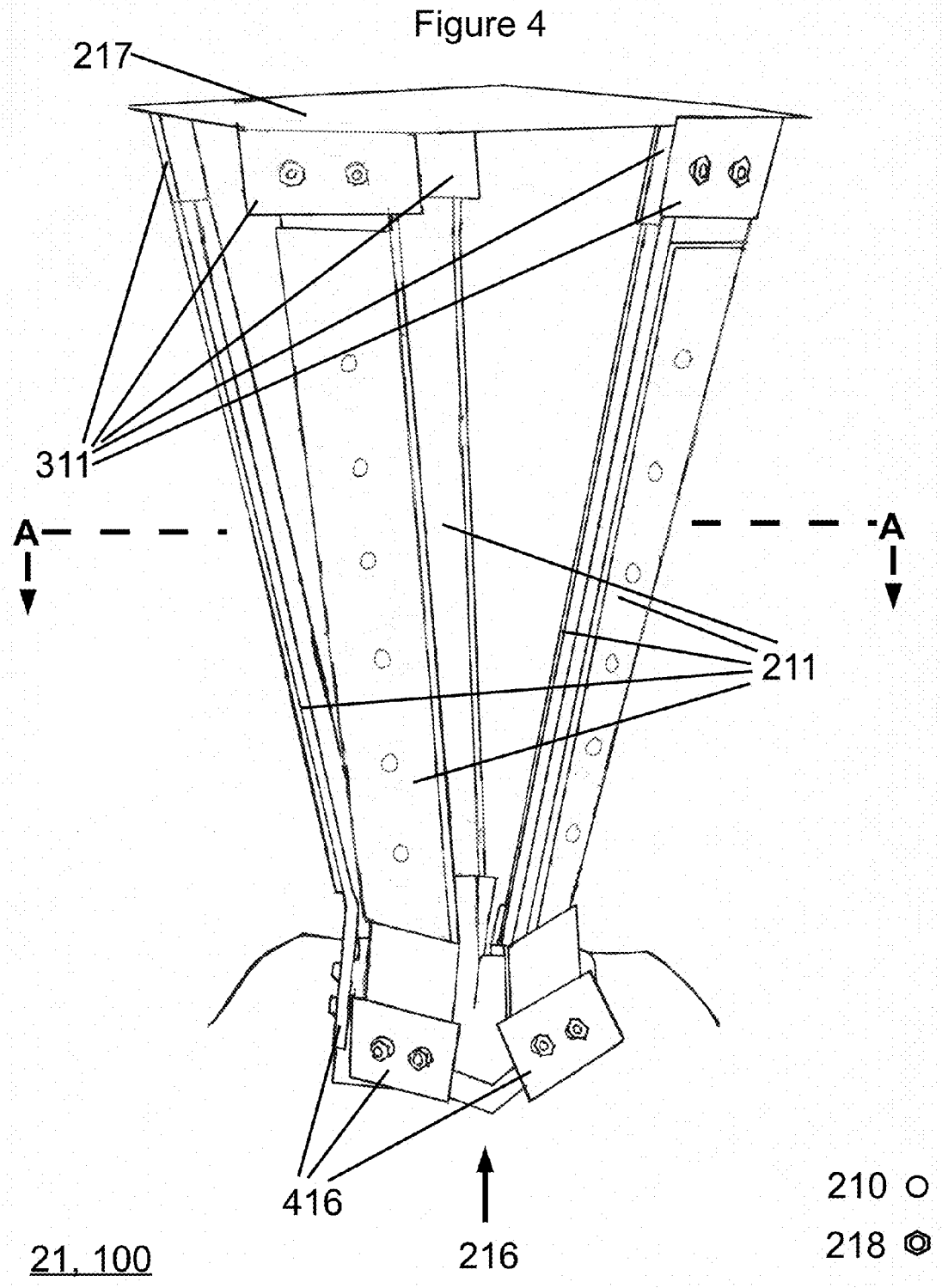
FIG. 4 illustrates a side view of one example of an inner portion of a luminaire.

The mounting plates 211 are disposed in the middle of the pentagonal sides of the top plate 217 of the lighting module 21. FIGS. 3 and 4 illustrate examples in which the top plate 217 of the lighting module 21 includes top plate tabs 311 that are disposed over a portion of the mounting plates 211 in order to secure the top of the mounting plates 211. Each respective mounting plate 211 is affixed to a top plate tab 311 with a pair of screws 218.

Figure 2:
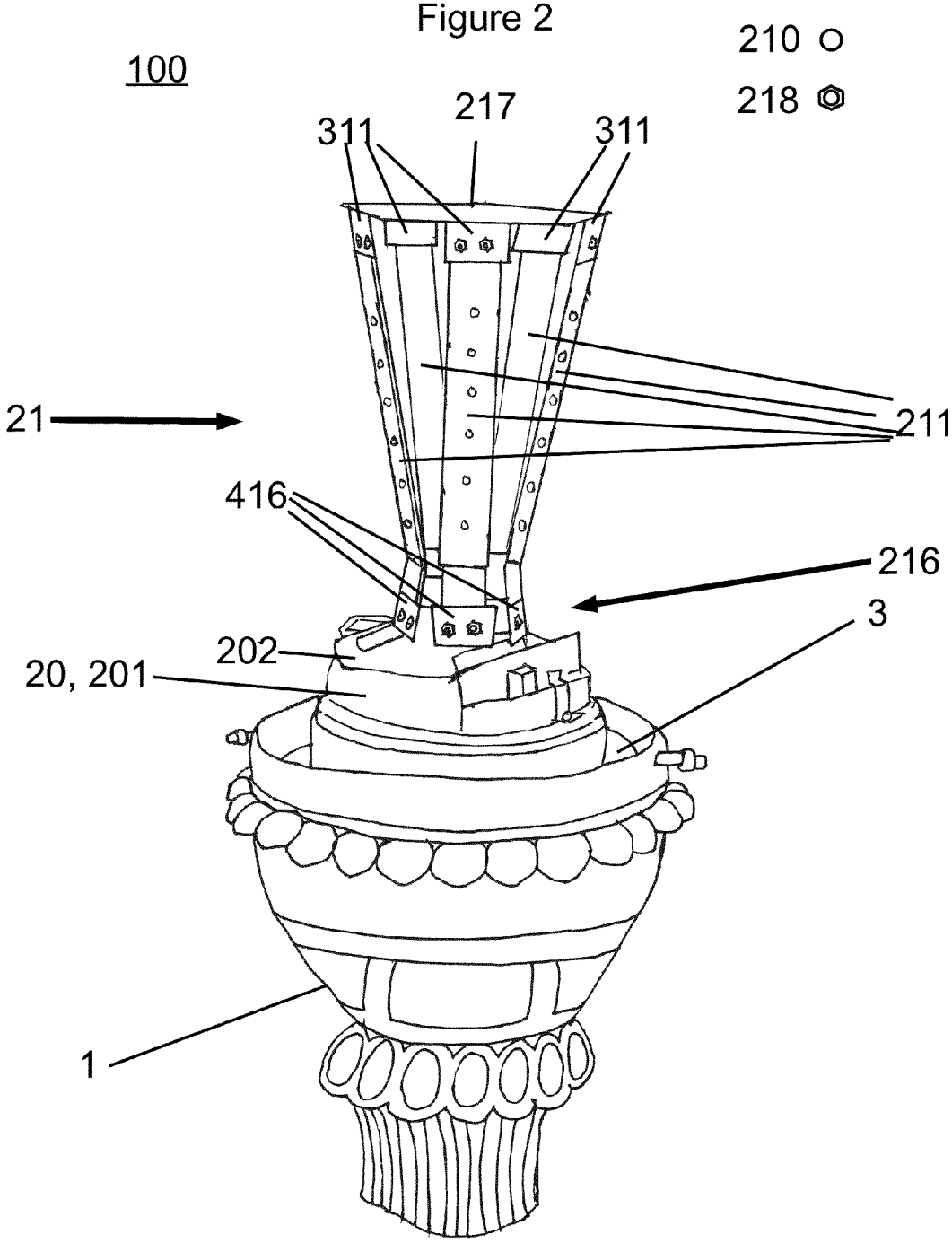
FIG. 2 illustrates an example of an inner portion of the luminaires.

In addition, as previously mentioned, the mounting plates 211 are also affixed to the bottom portion 216 of the lighting module 21. FIGS. 2, 3, and 5 illustrate examples in which the bottom portion 216 of the lighting module 21 includes bottom portion tabs 416 that are disposed over a portion of the mounting plates 211 in order to secure a bottom of the mounting plates 211. Each respective mounting plate 211 is affixed to a bottom portion tab 416 with a pair of screws 218.

The bottom portion 216 of the lighting module 21 is disposed on the top portion 202 of the housing 201 of the power supply 20 such that the lighting module 21 may be rotated on the top portion of the housing 201 in order to optimally position the lighting module 21 for the illumination of a desired subject. The bottom portion 216 of the lighting module 21 is also capable of being designed specifically to enable the optimal positioning of the lighting module 21 for the illumination of a desired subject.

FIGS. 7-10 illustrate examples, respectively, of a plan view, a side view, a top surface 950 of a top plate 827, and a bottom surface 960 of a top plate 827 of an inner portion of the luminaire 800 having field-adjustable mounting plates 811, 812, 813, 814, 815. The luminaires 100, 800 may share implementation of several features. For example, as is the case with the mounting plates 211 of the luminaire 100, the mounting plates 811, 812, 813, 814, 815 are used to mount LEDs 210 for illumination purposes. Just like the mounting plates 211 featured in FIGS. 2-6, the mounting plates 811, 812, 813, 814, 815 also may be oriented through specific design in any way necessary to effectively illuminate a desired subject with the LEDs 210. Like the mounting plates 211, the mounting plates 811, 812, 813, 814, 815 are connected to the bottom portion 216 of the lighting module 21 via the bottom portion tabs 416 with screws 218.

However, there may be several notable differences between the luminaires 100, 800. The mounting plates 811, 812, 813, 814, 815 have upper portions 816, 817, 818, 819, 820 that are folded such that the ends of the upper portions 816, 817, 818, 819, 820 are oriented towards a center portion 890 of the lighting module 81. Upper portions 816, 817, 818, 819, 820 include holes 840 designed to receive screws 918.

A top plate 827 of the lighting module 81 of the luminaire 800 includes slots 830 which run from an outer edge of the top plate 827 to a point adjacent to the center portion 890 of the lighting module 81. The slots 830 are designed to allow the downward insertion of screws 918 into the holes 840 of the upper portions 816, 817, 818, 819, 820. The screws 918 are inserted through the slots 830 and into the holes 840 included in the upper portions 816, 817, 818, 819, 820. Heads of the screws 918 are larger than the slots 830. Nuts 219 are threaded upward on the bottoms of the screws 918 until flush with a surface of the upper portions 816, 817, 818, 819, 820. The nuts 219 are larger than the holes 840.

Using threading on the screws 918, the nuts 219 affix the upper portions 816, 817, 818, 819, 820 of the mounting plates 811, 812, 813, 814, 815 to the slots 830 of the top plate 827. The bottom surface 960 of the top plate 827 on which the nuts 219 affix the upper portions 816, 817, 818, 819, 820 includes a reflective material to make illumination more efficient. When the nuts 219 tighten the connection between the upper portions 816, 817, 818, 819, 820 to the top plate 827, movement of the upper portions 816, 817, 818, 819, 820 and, subsequently, the mounting plates 811, 812, 813, 814, 815 is prevented. When the nuts 219 are loosened, the upper portions 816, 817, 818, 819, 820 and, subsequently, the mounting plates 811, 812, 813, 814, 815 may be adjusted in and out from the center portion 890 of the lighting module 81 using the slots 830 of the top plate 827 in order to achieve a more or less acute angle between the mounting plates 811, 812, 813, 814, 815 and a ground surface.

Top plate tabs 841 of the top plate 827 of the lighting module 81 of the luminaire 800 are smaller than the top plate tabs 311 of the top plate 217 of the lighting module 21 of the luminaire 100. Also, unlike the top plate tabs 311, the top plate tabs 841 do not provide means for providing screws to the mounting plates 811, 812, 813, 814, 815 for affixation. The top plate tabs 841 are included for the stability of the top plate 827 of the lighting module 81 when one of the mounting brackets 811, 812, 813, 814, 815 is moved near the outer edge of the top plate 827. The top plate tabs 841 are oriented downward from the outer edges of the top plate 217 of the lighting module 81 and prevent the upper portions 816, 817, 818, 819, 820 of the mounting plates 811, 812, 813, 814, 815 from sliding in the slots 830 past the outer edge of the top plate 827 of the lighting module 81. The top plate tabs 841 also allow the top plate 827 to conform to the angularity of the resulting respective surfaces of the mounting plates 811, 812, 813, 814, 815. The angle of the upper portions 816, 817, 818, 819, 820 is set such that the top plate tabs 841 are flexible to conform to various mating angles with respect to the upper portions 816, 817, 818, 819, 820.

The adjustability of the field-adjustable mounting plates 811, 812, 813, 814, 815 allows for changes in light output and alignment with the cover 2 to accommodate situational concerns, such as a layout of a specific area surrounding the luminaire 800, area obstructions that may impact illumination, and curvature in pathways designated to be illuminated. Specifically, the mounting plates 811, 812, 813, 814, 815 can be adjusted to compensate for illumination weaknesses in a cover that are enabled due to the decorative design of a cover. The adjustability of the mounting plates 811, 812, 813, 814, 815 provides for maximum flexibility when adjusting the mounting plates to function optimally with the cover 2 or with any provided cover, and provides flexibility during the positioning of the luminaire 800 for the optimal illumination of a desired subject.

Figure 11:
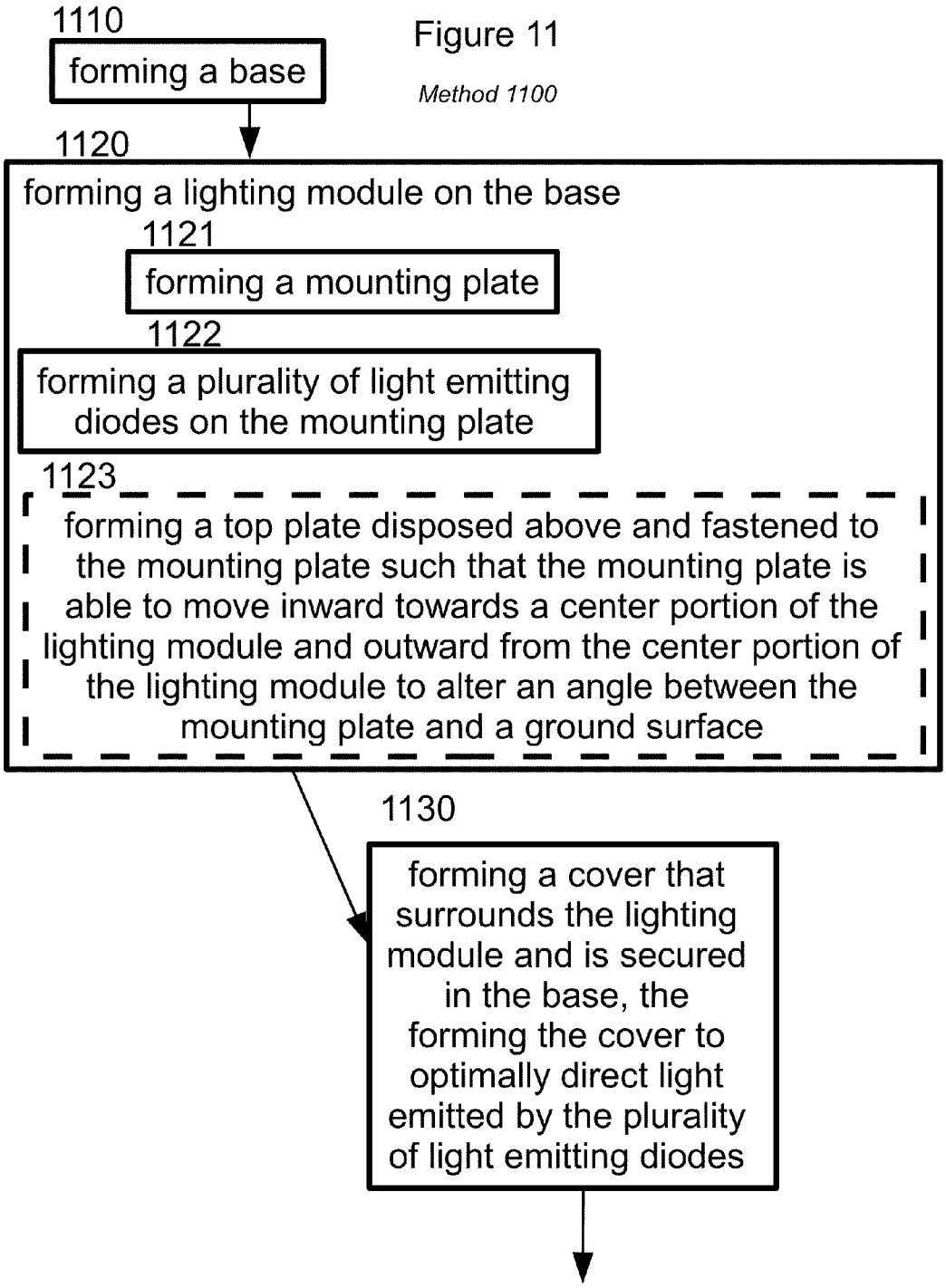
FIG. 11 is a flow chart illustrating an example of a method of manufacturing a luminaire.

FIG. 11 is a flow chart illustrating an example of a method 1100 of manufacturing a luminaire. The method 1100 includes forming (1110) a base, forming (1120) a lighting module on the base, the forming the lighting module including forming (1121) a mounting plate, and forming (1122) a plurality of light emitting diodes on the mounting plate, and forming (1130) a cover that surrounds the lighting module and is secured in the base, the forming the cover to optimally direct light emitted by the plurality of light emitting diodes.

The method may further provide that the forming the lighting module further includes forming (1123) a top plate disposed above and fastened to the mounting plate such that the mounting plate is able to move inward towards a center portion of the lighting module and outward from the center portion of the lighting module to alter an angle between the mounting plate and a ground surface.

Figure 12:
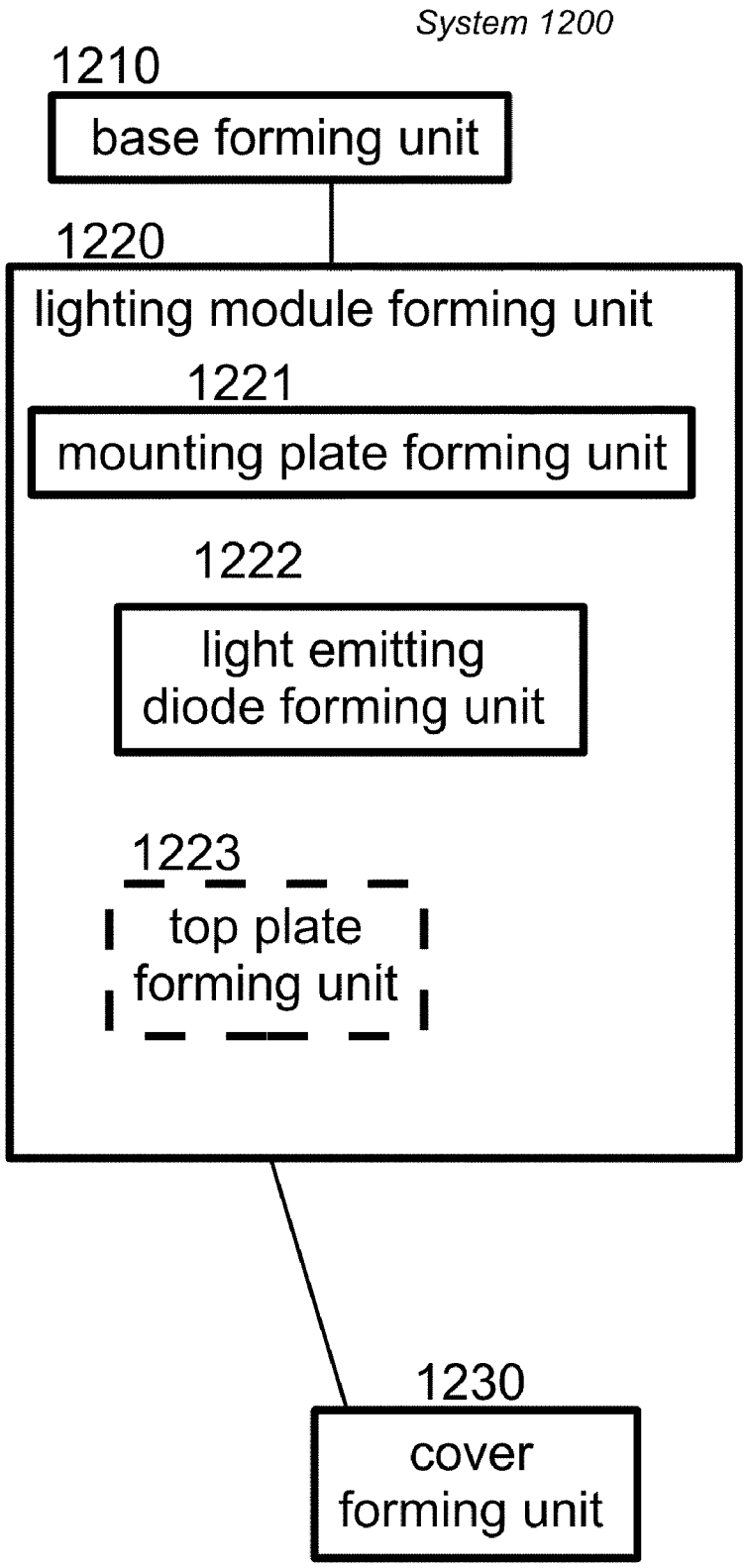
FIG. 12 is a flow chart illustrating an example of a luminaire system.

FIG. 12 is a flow chart illustrating an example of a luminaire system 1200. The luminaire system 1200 includes a base forming unit (1210) for forming a base, a lighting module forming unit (1220) for forming a lighting module on the base, the lighting module forming unit including a mounting plate forming unit (1221) for forming a mounting plate, and a light emitting diode forming unit (1222) for forming a plurality of light emitting diodes on the mounting plate, and a cover forming unit (1230) for forming a cover that surrounds the lighting module, is secured in the base, and optimally directs light emitted by the plurality of light emitting diodes.

The system may further provide that the lighting module forming unit further includes a top plate forming unit (1223) for forming a top plate disposed above and fastened to the mounting plate such that the mounting plate is able to move inward towards a center portion of the lighting module and outward from the center portion of the lighting module to alter an angle between the mounting plate and a ground surface.

In both of the luminaires 100, 800, the use of LED technology solves many problems inherent with the use of HPS devices. A low energy 120 VAC source can be converted by the power supply 20 of the luminaires 100, 800 to a direct current for supplying the LEDs 210 with power. The power supply 20 is actively being regulated in order to maintain light output. This ensures that the voltage and current will be maintained. This is unlike the HPS device, where opportunities exist for voltage spikes, high currents, and increasing voltage over the life span of the HPS device.

In addition, the LEDs 210 have a very low heat generation and are safe to the touch. Moreover, the heat that is generated by the LEDs 210 is effectively dispersed by the mounting plates 211-215, 411-415 such that the heat generated by the LEDs 210 does not affect either the operation or the maintenance of the luminaires 100, 800.

Further, the LEDs 210 of the luminaires 100, 800 require very little maintenance. The power supply 20 powering the LEDs 210 typically has a life span in a range of 7 to 10 years. The LEDs 210 typically have a life span in a range of 50,000 to 100,000 hours, which comparatively dwarfs the 10,000 to 24,000 hour range life span of the HPS device bulb. Plus, the LEDs 210 are shock and vibration resistant, which prevents further unexpected maintenance of the luminaires 100, 800.

Moreover, the color rendering of the LEDs 210 in the luminaires 100, 800 is significantly better than the HPS device. Specifically, while the light emitted from the HPS device is yellow, the light emitted from the LEDs 210 is white. This promotes a truer, more accurate color of illumination subjects. Also, unlike the HPS device, which is required to have a "warm-up" period, the LEDs 210 are able to have an immediate full intensity light output. Finally, unlike the HPS device, the LEDs 210 included in the luminaires 100, 800 contain no mercury.

Modifications can be made to the foregoing without departing from the scope of the following claims.

It will be appreciated by persons skilled in the art that the following claims are not limited to the examples described herein. Rather, the scope of the following claims includes both combinations and sub-combinations of the various examples described herein, as well as variations and modifications thereof, which would occur to persons skilled in the art upon reading the foregoing description.

What is claimed is:

1. A luminaire, comprising:

a base;

a lighting module disposed on said base, said lighting module comprising:

a plurality of mounting plates extending upward from said base at approximately equidistant points about a central axis;

a top plate securing a top portion of each of said mounting plates to an edge of said top plate; and a plurality of light emitting diodes provided on each of said mounting plates; and a cover surrounding said lighting module and secured in said base, said cover optimally directing light emitted by said plurality of light emitting diodes.

2. The luminaire according to claim 1, wherein:

said top plate comprises a plurality of top plate tabs extending downward;

said lighting module further comprises a bottom portion, said bottom portion comprising a plurality of bottom portion tabs extending upward; and each of said mounting plates is fastened to and extends between corresponding ones of said top plate tabs and said bottom portion tabs.

3. The luminaire according to claim 2, wherein said bottom portion of said lighting module is configured to freely rotate said plurality of mounting plates about said central axis.

4. The luminaire according to claim 2, wherein said top plate of said lighting module has a surface area that is greater than a surface area of said bottom portion of said lighting module such that each of said mounting plates is fastened to said corresponding one of said top plate tabs at a distance from said central axis that is greater than a distance from said central axis at which each of said mounting plates is fastened to said corresponding one of said bottom portion tabs.

5. The luminaire according to claim 1, wherein:

each of said mounting plates comprises a heat-conducting material; and said plurality of light emitting diodes is formed on said heat-conducting material.

6. The luminaire according to claim 5, wherein said lighting module further comprises a heat sink formed adjacent to said heat-conducting material of each of said mounting plates.

7. The luminaire according to claim 1, wherein:

said plurality of light emitting diodes is connected to a power supply providing primarily direct current to said plurality of light emitting diodes; and said lighting module is disposed on said power supply.

8. The luminaire according to claim 1, wherein said lighting module further comprises a bottom plate rotatably attached to said base, said bottom plate securing a bottom portion of each of said mounting plates, said bottom plate being configured to freely rotate said plurality of mounting plates and said top plate about said central axis.

9. The luminaire according to claim 8, wherein each of said mounting plates are secured to said top plate at a distance from said central axis that is greater than a distance from said central axis at which each of said mounting plates are secured to said bottom plate.

10. The luminaire according to claim 1, wherein said top portion of each of said mounting plates is folded to be oriented toward said central axis.

11. A luminaire, comprising:

a base;

a lighting module disposed on said base, said lighting module comprising:

a mounting plate;

a plurality of light emitting diodes provided on said mounting plate; and a top plate disposed above and fastened to said mounting plate such that said mounting plate is able to move inward towards a center portion of said lighting module and outward from said center portion of said lighting module to alter an angle between said mounting plate and a ground surface; and a cover surrounding said lighting module and secured in said base, said cover optimally directing light emitted by said plurality of light emitting diodes.

12. The luminaire according to claim 11, wherein said top plate is fastened to said mounting plate at an upper portion of said mounting plate, said upper portion of said mounting plate folded such that an end of the upper portion is oriented towards said center portion of said lighting module.

13. The luminaire according to claim 12, wherein said top plate includes a slot in which a fastener is placed, wherein said upper portion of said mounting plate includes a hole in which said fastener is disposed, and wherein said lighting module further comprises a fitting that is disposed on said fastener and fixes said upper portion of said mounting plate to said top plate.

14. The luminaire according to claim 11, wherein said top plate comprises a top plate tab that extends downward from said top plate and prevents said mounting plate from moving past an outer edge of said top plate.

15. The luminaire according to claim 11, wherein said top plate includes a slot in which a fastener is placed, wherein said mounting plate includes a hole in which said fastener is disposed, and wherein said lighting module further comprises a fitting that is disposed on said fastener and fixes said mounting plate to said top plate.

16. The luminaire according to claim 1, wherein said lighting module further comprises a bottom portion, said bottom portion comprising a bottom portion tab to which each of said mounting plate is fastened, said bottom portion tab extending upward.

17. A luminaire, comprising:

a lighting module disposed on a base, said lighting module comprising:

a plurality of light emitting diodes provided on a mounting plate; and a top plate configured to adjustably secure a top portion of said mounting plate between a center portion of said top plate and an edge of said top plate; and a cover surrounding said lighting module and secured in said base, said cover optimally directing light emitted by said plurality of light emitting diodes.

18. The luminaire according to claim 17, wherein said lighting module further comprises a bottom plate rotatably secured to said base, a bottom portion of said mounting plate being secured to said bottom plate, said bottom plate being configured to freely rotate said plurality of mounting plates and said top plate about a central axis.

19. The luminaire according to claim 17, wherein said top plate is further configured to enable said top portion of said mounting plate to move inward towards a central axis outward from said central axis to alter an angle between said mounting plate and a ground surface.

* * * * *